US011133136B2

(12) United States Patent
Matsushima et al.

(10) Patent No.: US 11,133,136 B2
(45) Date of Patent: Sep. 28, 2021

(54) SWITCH

(71) Applicant: Fujikura Ltd., Tokyo (JP)

(72) Inventors: Yasuyuki Matsushima, Chiba (JP); Wataru Tanaka, Tokyo (JP); Yasuyuki Tachikawa, Tokyo (JP)

(73) Assignee: Fujikura Ltd., Tokyo (JP)

( * ) Notice: Subject to any disclaimer, the term of this patent is extended or adjusted under 35 U.S.C. 154(b) by 38 days.

(21) Appl. No.: 16/622,544

(22) PCT Filed: Jun. 18, 2018

(86) PCT No.: PCT/JP2018/023122
§ 371 (c)(1),
(2) Date: Dec. 13, 2019

(87) PCT Pub. No.: WO2018/235776
PCT Pub. Date: Dec. 27, 2018

(65) Prior Publication Data

US 2021/0151266 A1 May 20, 2021

(30) Foreign Application Priority Data

Jun. 20, 2017 (JP) ..... JP2017-120714

(51) Int. Cl.
*H01H 13/703* (2006.01)
*H01H 13/10* (2006.01)
(Continued)

(52) U.S. Cl.
CPC ..... *H01H 13/703* (2013.01); *H01H 13/10* (2013.01); *H01H 13/81* (2013.01); *H01H 13/82* (2013.01)

(58) Field of Classification Search
CPC ..... G06F 3/045; H01H 13/703; H01H 2201/036; H01H 13/78; H01H 2229/028;
(Continued)

(56) References Cited

U.S. PATENT DOCUMENTS

| | | | | |
|---|---|---|---|---|
| 7,528,337 | B2 | 5/2009 | Tanabe et al. | |
| 2003/0000821 | A1 | 1/2003 | Takahashi et al. | |
| 2017/0205935 | A1* | 7/2017 | Katayama ..... | G06F 3/045 |

FOREIGN PATENT DOCUMENTS

| | | | |
|---|---|---|---|
| CN | 1129158 | C | 11/2003 |
| CN | 1885245 | A | 12/2006 |

(Continued)

OTHER PUBLICATIONS

International Search Report issued in corresponding International Application No. PCT/JP2018/023122, dated Aug. 7, 2018 (3 pages).

*Primary Examiner* — Ahmed M Saeed
(74) *Attorney, Agent, or Firm* — Osha Bergman Watanabe & Burton LLP

(57) ABSTRACT

A switch includes: a first electrode sheet including a first electrode; a second electrode sheet including a second electrode that faces the first electrode sheet; and an adhesive that includes a first opening through which the first electrode faces the second electrode sheet and that attaches the first electrode sheet to the second electrode sheet. The first electrode sheet includes: a first substrate on which the first electrode is disposed; a first spacer between the first substrate and the second electrode sheet that includes a second opening at a position corresponding to the first electrode; and a first base between the first substrate and the first spacer that overlaps at least a portion of an edge of the first opening of the adhesive. The first spacer is attached to the second electrode sheet by the adhesive.

10 Claims, 10 Drawing Sheets

(51) Int. Cl.
*H01H 13/81* (2006.01)
*H01H 13/82* (2006.01)

(58) Field of Classification Search
CPC ..... H01H 13/702; H01H 13/10; H01H 13/81; H01H 13/82; H01H 13/704
See application file for complete search history.

(56) References Cited

FOREIGN PATENT DOCUMENTS

| | | | |
|---|---|---|---|
| CN | 201622959 | U | 11/2010 |
| CN | 203299746 | U | 11/2013 |
| CN | 104599878 | A | 5/2015 |
| EP | 2919249 | A1 | 9/2015 |
| JP | H08287775 | A | 11/1996 |
| JP | 2002140954 | A | 5/2002 |
| JP | 2002358852 | A | 12/2002 |
| JP | 3869203 | B2 | 1/2007 |
| TW | I579879 | B | 4/2017 |
| WO | 02097837 | A1 | 12/2002 |
| WO | 2012013631 | A1 | 2/2012 |

* cited by examiner

SWITCH

CROSS-REFERENCE TO RELATED APPLICATIONS

This is a U.S. National Stage application of International Application No. PCT/JP2018/023122 filed Jun. 18, 2018, which claims priority to Japanese Patent Application No. 2017-120714 filed Jun. 20, 2017. These reference are incorporated herein by reference in their entirety.

TECHNICAL FIELD

The present invention relates to a switch.

BACKGROUND

There is known a switch which includes upper and lower electrode sheets and a spacer interposed between the upper and lower electrode sheets and forming a predetermined space between the upper and lower electrode sheets and in which the upper and lower electrode sheets and the spacer are attached to each other via an adhesive (see, for example, Patent document 1).

PATENT LITERATURE

Patent document 1: JP 2002-358852 A

In the above-mentioned switch, an opening though which the upper and lower electrodes contact is formed in the spacer, and an adhesive is provided around the opening of the spacer by printing or the like. When the adhesive is provided on the spacer by printing, sagging may occur in the edge portion of the adhesives around the opening of the spacer.

On the other hand, when the electrode sheet is thinned for the purpose of thinning the switch, the rigidity of the electrode sheet is lowered. Therefore, when the switch is pressed, the electrode sheet is adhered in a state following the portion of the adhesive where the sagging occurs, so that the contact point portion of the electrode sheet may be recessed. In this case, there is a possibility that the upper and lower electrodes are kept close to each other and the switch is unintentionally turned on.

SUMMARY

One or more embodiments of the present invention provide a switch capable of restraining a recess occurring in a contact portion of an electrode sheet.

[1] A switch according to the present invention is a switch includes a first electrode sheet including a first electrode; a second electrode sheet including a second electrode facing the first electrode sheet; and an adhesive having a first opening portion (first opening) through which the first electrode and the second electrode sheet face each other and attaching the first electrode sheet and the second electrode sheet to each other; in which the first electrode sheet includes: a first substrate on which the first electrode is formed; a first spacer provided between the first substrate and the second electrode sheet, having a second opening portion (second opening) at a position corresponding to the first electrode, and attached to the second electrode sheet by the adhesive; and a first base portion (first base) provided between the first substrate and the first spacer and disposed so as to overlap at least a portion of an edge portion (edge) of the first opening portion of the adhesive, and the first spacer is raised toward the second electrode sheet at a portion corresponding to the first base portion by the first base portion.

[2] In the above invention, the first electrode sheet may include a lead wiring connected to the first electrode and led out to the outside of the second opening portion, and the first base portion may have an annular shape surrounding the first electrode and having a slit portion (slit) at a portion corresponding to the lead wiring.

[3] In the above invention, a thickness of the first base portion may be substantially the same as (may be identical to) a thickness of the lead wiring.

[4] In the above invention, a material composition of the first base portion may be the same as (may be identical to) a material composition of the lead wiring.

[5] In the above invention, the second electrode sheet may include: a second substrate on which the second electrode is formed; a second spacer provided between the second substrate and the first electrode sheet, having a third opening portion (third opening) at a position corresponding to the second electrode, and attached to the first electrode sheet by the adhesive; and a second base portion (second base) provided between the second substrate and the second spacer and disposed in at least a part of a region overlapping an edge portion (edge) of the first opening portion of the adhesive, the second spacer may be raised toward the first electrode sheet at a portion corresponding to the second base portion by the second base portion.

[6] In the above invention, the following formula (1) may be satisfied.

$$\frac{1}{2} \times ta \leq tb + tc \leq ta \quad (1)$$

In the above equation (1), ta is a thickness of the adhesive, tb is a thickness of the first base portion, and tc is a thickness of the second base portion.

[7] In the above invention, the second electrode sheet may include a second substrate on which the second electrode is formed, and the first spacer may be attached to the second substrate by the adhesive.

[8] In the above invention, the following formula (2) may be satisfied.

$$\frac{1}{2} \times ta \leq tb \leq ta \quad (2)$$

In the above equation (2), ta is a thickness of the adhesive, and tb is a thickness of the first base portion.

[9] In the above invention, the adhesive may be disposed outside a periphery of the second opening portion.

[10] In the above invention, a rigidity of the first spacer may be higher than a rigidity of the adhesive.

[11] In the above invention, the first spacer may be thinner than the first substrate.

According to the present invention, the first base portion is disposed in at least a portion of the region overlapping the edge portion of the opening of the adhesive, and the first spacer is raised (swelled) toward the second electrode sheet by the first base portion. By offsetting the sag of the adhesive by the rise of the first spacer, it is possible to restrain the recess occurring in the contact point portion of the first electrode sheet.

DETAILED DESCRIPTION

Embodiments of the present invention will be described below with reference to the drawings.

Figure 1:
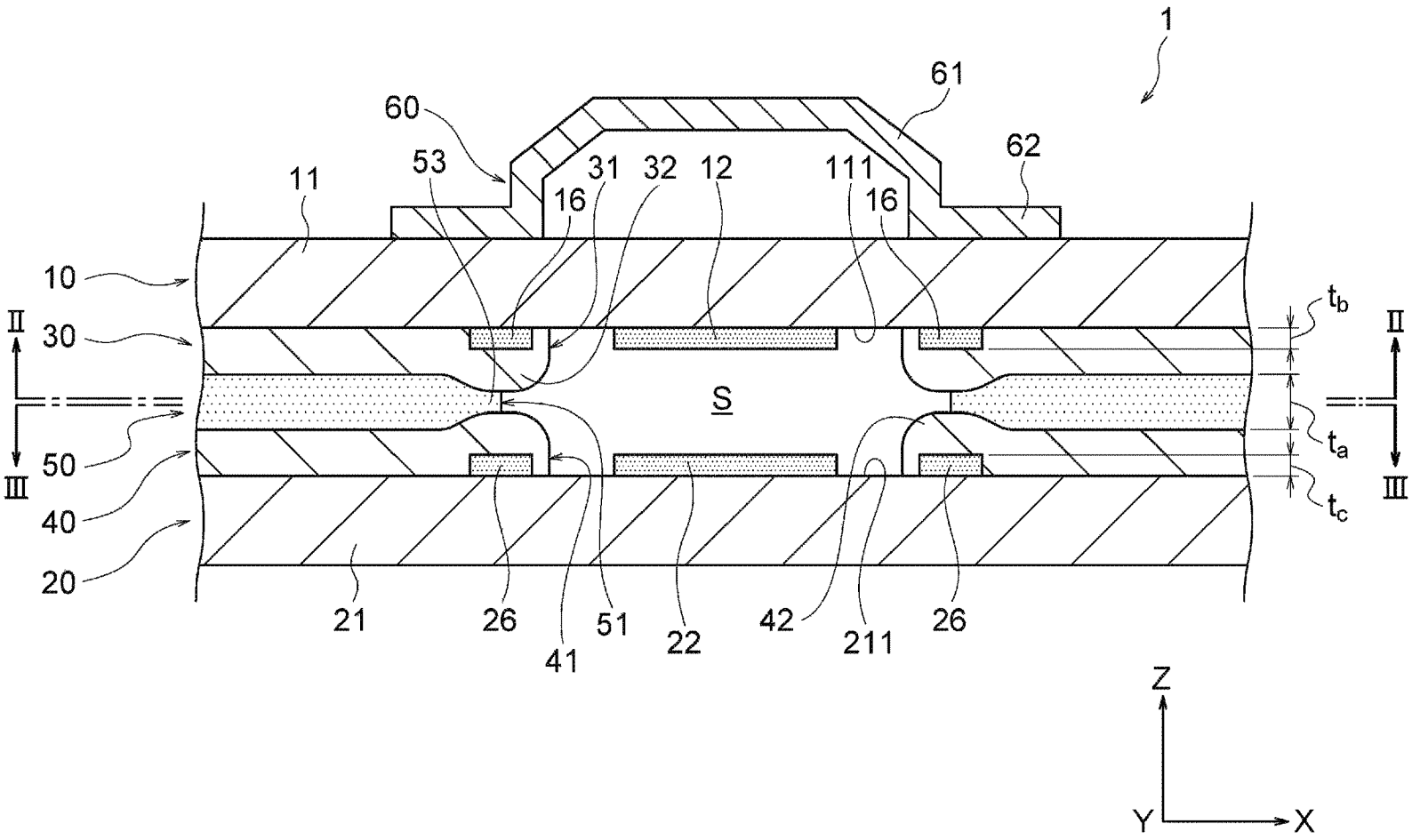
FIG. 1 is a cross-sectional view showing a contact portion of a membrane switch according to one or more embodiments of the present invention.
Figure 2:
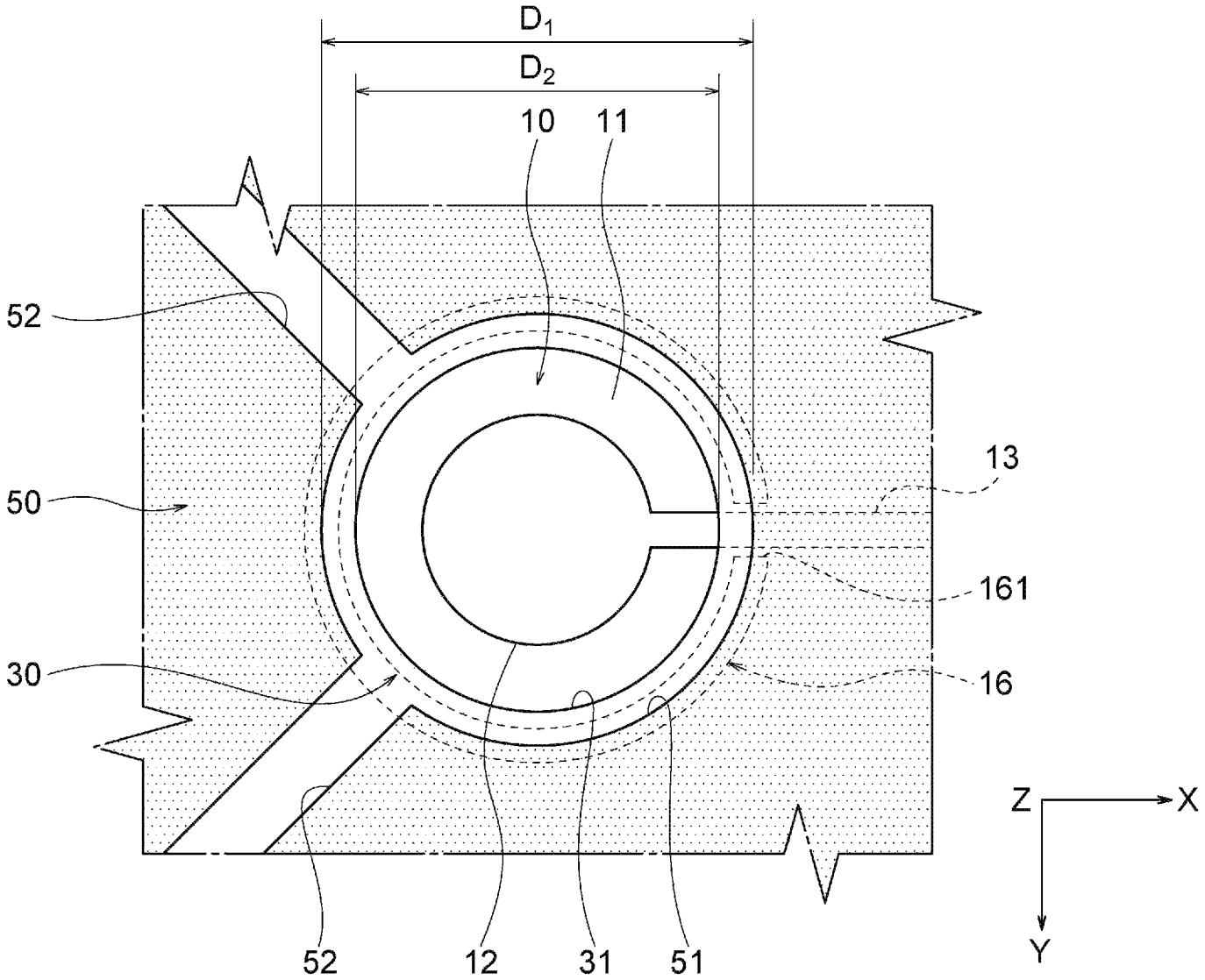
FIG. 2 is a cross-sectional view taken along the II-II line in FIG. 1.
Figure 3:
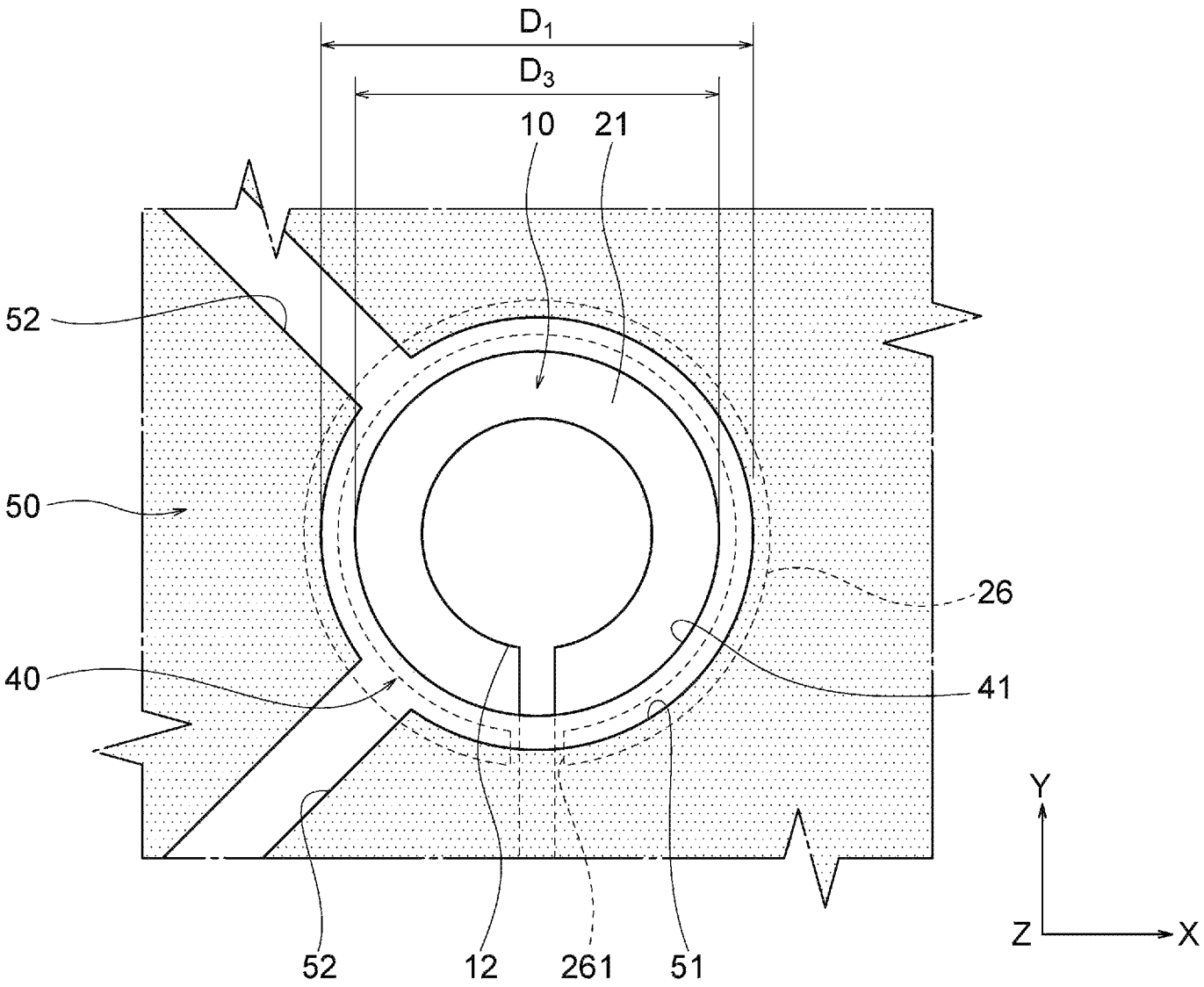
FIG. 3 is a cross-sectional view taken along the II-II line in FIG. 1.

FIG. 1 is a cross-sectional view showing a contact portion of the membrane switch 1 according to one or more embodiments of the present invention, FIG. 2 is a cross-sectional view taken along the II-II line in FIG. 1, and FIG. 3 is a cross-sectional view taken along the III-III line in FIG. 1.

As shown in FIGS. 1 to 3, the membrane switch 1 according to one or more embodiments includes an upper electrode sheet 10, a lower electrode sheet 20, an adhesive layer 50, and a rubber dome 60 as a pressing member. The upper electrode sheet 10 includes an upper substrate 11, an upper electrode 12, and an upper insulating layer 30. The lower electrode sheet 20 includes a lower substrate 21, a lower electrode 22, and a lower insulating layer 40.

In the membrane switch 1, the upper insulating layer 30 is formed on the lower surface 111 of the upper substrate 11 of the upper electrode sheet 10, the lower insulating layer 40 is formed on the upper surface 211 of the lower substrate 21 of the lower electrode sheet 20, and the upper insulating layer 30 and the lower insulating layer 40 are bonded to each other via the adhesive layer 50. The rubber dome 60 is attached to the upper surface of the upper substrate 11 of the upper electrode sheet 10.

In the membrane switch 1, a predetermined pressing force is applied to the upper electrode sheet 10 by an operator through the rubber dome 60, and the upper and lower electrodes 12 and 22 (described later) contact each other, so that the electrodes 12 and 22 are electrically connected to each other. The upper and lower electrodes 12 and 22 are connected to an external circuit (not shown) via the lead wires 13 and 23, and the upper and lower electrodes 12 and 22 are electrically connected to each other, so that the external circuit detects the pressing operation of the operator. According to one or more embodiments, the pressing force when the external circuit detects the pressing operation of the operator is called an "ON load".

The detection of the pressing operation of the operator by the membrane switch 1 is not particularly limited to the above. For example, the pressing operation of the operator may be detected on the basis of a circuit resistance value that increases or decreases in accordance with a change in the contact area (contact state) of the upper and lower electrodes 12 and 22 in accordance with the pressing force. The "membrane switch 1" according to one or more embodiments corresponds to an example of the "switch" in the present invention.

The upper substrate 11 of the upper electrode sheet 10 is made of, for example, an insulating material having flexibility such as polyethylene terephthalate or polyethylene naphthalate. From the viewpoint of thinning of the membrane switch 1, the thickness of the upper substrate 11 is set in the range of 20 to 100 μm, or in the range of 20 to 75 μm. According to one or more embodiments, the thickness of the upper substrate 11 is set to 50 μm.

The upper electrode 12 is formed by printing and curing a conductive paste such as a silver paste, a copper paste, or a carbon paste on the lower surface 111 of the upper substrate 11. The upper electrode 12 may be formed of multiple layers. As a printing method for forming the upper electrode 12, a screen printing method, a gravure offset printing method, an inkjet printing method, or the like can be exemplified. The upper electrode 12 has a thickness of, for example, about 2 to 20 μm.

An upper lead wiring 13 is connected to the upper electrode 12. The upper lead wiring 13 leads out to the outside of the opening portion 31 of the upper insulating layer 30 in a see-through (transparent) plan view (a plan view when the membrane switch 1 is transparently viewed from above or below (in a normal direction of the membrane switch 1); see FIG. 2), and the upper electrode 12 is connected to an external circuit via the upper lead wiring 13.

Similarly to the upper electrode 12, the upper lead wiring 13 is formed by printing and curing a conductive paste such as a silver paste, a copper paste, or a carbon paste on the lower surface 111 of the upper substrate 11. As a printing method for forming the upper electrode 12, a screen printing method, a gravure offset printing method, an inkjet printing method, or the like can be exemplified. The upper electrode 12 and the upper lead wiring 13 may be integrally formed or may be individually formed. The upper lead wiring 13 has a thickness of, for example, about 2 to 20 μm.

The upper electrode 12 has a circular outer shape having a diameter smaller than that of the opening portions 31 and 41 (described later) of the upper and lower insulating layers 30 and 40. The upper electrode 12 is provided at a position corresponding to the upper and lower opening portions 31 and 41, and specifically, the center of the upper electrode 12 substantially coincides with the center of the upper and lower opening portions 31 and 41.

In this specification, the "center" is a point corresponding to the gravity center of the planar shape. The shape of the upper electrode 12 is not particularly limited to that described above. For example, the outer shape of the upper electrode 12 may be a rectangular shape, a mesh shape, a comb tooth shape, or the like.

The "upper electrode sheet 10" according to one or more embodiments corresponds to an example of the "first electrode sheet" in the present invention, the "upper substrate 11" according to one or more embodiments corresponds to an example of the "first substrate" in the present invention, and the "upper electrode 12" according to one or more embodiments corresponds to an example of the "first electrode" in the present invention.

The upper insulating layer 30 is formed by printing and curing a resist material such as a UV curable resin or a thermosetting resin such as an epoxy resin, a urethane resin, a polyester resin or an acrylic resin on the lower surface 111 of the upper substrate 11. As a printing method for forming the upper insulating layer 30, a screen printing method, a gravure offset printing method, an inkjet printing method, or the like can be exemplified. The upper insulating layer 30 is formed directly on the lower surface 111 of the upper substrate 11 while covering the upper lead wiring 13 and the upper base portion 16 (described later) without interposing an adhesive or the like.

From the viewpoint of reducing the thickness and increasing the rigidity of the membrane switch 1, the thickness of the upper insulating layer 30 is set in the range of 5 to 50 μm, or in the range of 10 to 30 μm. According to one or more embodiments, the thickness of the upper insulating layer 30 is set to 15 μm, which is smaller than the thickness of the upper substrate 11. According to one or more embodiments, from the viewpoint of improving the accuracy of the film thickness of the upper insulating layer 30, a UV curable resin is used as the resist material, and the upper insulating layer 30 is formed by curing the UV curable resin printed on the lower surface 111 of the upper substrate 11 by UV curing. The "thickness of the upper insulating layer 30" according to one or more embodiments is a thickness of a flat portion of the upper insulating layer 30 except for a portion raised by the upper base portion 16 (described later).

The rigidity of the upper insulating layer 30 is set higher than the rigidity of the adhesive layer 50. The "rigidity" according to one or more embodiments is the degree of difficulty of deformation of the member with respect to the force applied in the thickness direction of the member.

A circular opening portion 31 having a larger diameter than the upper and lower electrodes 12 and 22 is formed in the upper insulating layer 30. The opening portion 31 is provided so as to surround the upper electrode 12, and specifically, the center of the upper electrode 12 substantially coincides with the center of the opening portion 31. The diameter of the opening portion 31 is not particularly limited, but may be 5 mm or less from the viewpoint of stabilizing the ON load of the membrane switch 1. However, the diameter may also be 1 mm or more so that the ON load is not excessively increased.

The shape of the opening portion 31 is not limited to a circular shape, and may be, for example, a rectangular shape or the like. The "upper insulating layer 30" according to one or more embodiments corresponds to an example of the "first spacer" in the present invention, and the "opening portion 31" according to one or more embodiments corresponds to an example of the "second opening portion" in the present invention.

Further, the upper electrode sheet 10 according to one or more embodiments includes an upper base portion (a foundation) 16 interposed between the upper substrate 11 and the upper insulating layer 30. As shown in FIG. 2, the upper base portion 16 surrounds the upper electrode 12 and has an annular shape having a slit portion 161 at a position corresponding to the upper lead wiring 13. The slit portion 161 extends along the radial direction of the annular shape and divides the annular shape extending along the circumferential direction. By passing through the slit portion 161, the upper lead wiring 13 is led out to the outside of the opening portion 31 of the upper insulating layer 30 in a see-through plan view. The upper base portion 16 is disposed so as to include a region overlapping an edge portion 53 (described later) of the opening portion 51 of the adhesive layer 50 in a see-through plan view. By the upper base portion 16, the edge portion 32 of the opening portion 31 of the upper insulating layer 30 is raised (swelled) toward the lower electrode sheet 20 in comparison with other portions of the upper insulating layer 30.

The annular (ring) shape of the upper base portion 16 is not particularly limited to a true circle, and may be, for example, an ellipse, a triangle, a rectangle, a polygon, or the like. The shape of the upper base portion 16 is not limited to the annular shape having the slit portion 161 as long as the upper base portion 16 is arranged so as to overlap at least a part of the edge portion 53 of the opening portion 51 of the adhesive layer 50 (overlap at least a part of the peripheral edge of the opening portion 51 of the adhesive layer 50) while avoiding interference with the upper lead wiring 13. For example, the shape of the upper base portion 16 may be an intermittent annular shape (a shape composed of a plurality of islands arranged in an annular manner).

The upper base portion 16 is formed by printing and curing a conductive paste such as a silver paste, a copper paste, or a carbon paste on the lower surface 111 of the upper substrate 11, and is formed directly on the lower surface 111 of the upper substrate 11 without interposing an adhesive or the like. As a printing method for forming the upper base portion 16, a screen printing method, a gravure offset printing method, an inkjet printing method, or the like can be exemplified. As described above, since the upper insulating layer 30 covering the upper base portion 16 is formed on the lower surface 111 of the upper substrate 11 by the printing method, no void is formed between the upper base portion 16 and the upper insulating layer 30 (i.e., the periphery of the upper base portion 16 in the upper insulating layer 30), and the upper insulating layer 30 is in contact with the entire side surface (end surface) of the upper base portion 16.

The material of which the upper base portion 16 is made is not limited to the above-mentioned conductive material, and may be, for example, an electrically insulating material such as a resin material. However, the upper electrode 12 and the upper lead wiring 13 may be formed in the same process, and in this case, the material composition of the upper base portion 16 is the same as the material composition of the upper lead wiring 13. The rigidity of the upper base portion 16 may be set higher than the rigidity of the upper insulating layer 30.

The thickness of the upper base portion 16 is not particularly limited, but may be substantially the same as the thickness of the upper lead wiring 13. As a result, it is possible to restrain the occurrence of recesses (depressions) or protrusions on the surfaces of the substrates 11 and 21 at the portions corresponding to the slit portion 161 of the upper base portion 16. According to one or more embodiments, the upper base portion 16 has a thickness of about 2 to 20 μm.

The thickness of the upper base portion 16 and the thickness of the lower base portion 26 (described later) may satisfy the following equation (3). As a result, it is possible to restrain the occurrence of recesses (depressions) or protrusions on the surfaces of the substrates 11 and 21 at the positions corresponding to the base portions 16 and 26.

$$\frac{1}{2} \times ta \leq tb + tc \leq ta \quad (3)$$

In the above equation (3), ta is the thickness of the adhesive 50 and is the thickness of the flat portion of the adhesive 50 except for the edge portion 53 of the opening portion 51 as shown in FIG. 1. Also, tb is the thickness of the upper base portion 16, and tc is the thickness of the lower base portion 26. In the above equation (3), the reason why the lower limit value of ta is set to half of tc is based on the fact that the depth of the recess generated in the contact point portion of the electrode sheet due to the sagging of the adhesive is half or more of the thickness of the adhesive.

Similarly to the upper substrate 11, the lower substrate 21 of the lower electrode sheet 20 is made of an insulating material having flexibility such as polyethylene terephthalate or polyethylene naphthalate. From the viewpoint of thinning the membrane switch 1, the thickness of the lower base 21 is set in the range of 20 to 100 μm, or in the range of 20 to 75 μm. According to one or more embodiments, the thickness of the lower substrate 21 is set to 50 μm.

Similarly to the upper electrode 12, the lower electrode 22 is formed by printing and curing a conductive paste such as a silver paste, a copper paste, or a carbon paste on the upper surface 211 of the lower substrate 21. The lower electrode 22 may also be formed of multiple layers. As a method of forming the lower electrode 22, a method similar to the method of forming the upper electrode 12 described above can be exemplified. The lower electrode 22 has a thickness of, for example, about 2 to 20 μm.

Similarly to the upper electrode 12, a lower lead wire 23 is connected to the lower electrode 22. The lower lead wiring 23 leads out to the outside of the opening portion 41 of the lower insulating layer 40 in a see-through plan view (see FIG. 3), and the lower electrode 22 is connected to an external circuit via the lower lead wiring 23.

Similarly to the lower electrode 22, the lower lead wiring 23 is formed by printing and curing a conductive paste such as silver paste, copper paste, or carbon paste on the upper surface 211 of the lower substrate 21. As a printing method for forming the lower electrode 22, a screen printing method, a gravure offset printing method, an inkjet printing method, or the like can be exemplified. The lower electrode 22 and the lower lead wiring 23 may be formed integrally or individually. The lower lead wiring 23 has a thickness of, for example, about 2 to 20 μm.

The lower electrode 22 has a circular outer shape having a diameter smaller than that of the opening portions 31 and 41 of the upper and lower insulating layers 30 and 40 which will be described later. The lower electrode 22 is provided at a position facing the upper electrode 12 via the internal space S, and specifically, the center of the lower electrode 22 substantially coincides with the center of the upper electrode 12. The shape of the lower electrode 22 is not particularly limited to that described above. For example, the outer shape of the lower electrode 22 may be a rectangular shape, a mesh shape, a comb tooth shape, or the like.

The "lower electrode sheet 20" according to one or more embodiments corresponds to an example of the "second electrode sheet" in the present invention, the "lower substrate 21" according to one or more embodiments corresponds to an example of the "second substrate" in the present invention, and the "lower electrode 22" according to one or more embodiments corresponds to an example of the "second electrode" in the present invention.

The lower insulating layer 40 is formed by printing and curing a resist material such as a UV curable resin or a thermosetting resin such as an epoxy resin, a urethane resin, a polyester resin or an acrylic resin on the upper surface 211 of the lower substrate 21. As a printing method for forming the lower insulating layer 40, a screen printing method, a gravure offset printing method, an inkjet printing method, or the like can be exemplified as in the case of the upper insulating layer 30. The lower insulating layer 40 is formed directly on the upper surface 211 of the lower substrate 21 while covering the lower lead wiring 23 and the lower base portion 26 (described later) without interposing an adhesive or the like.

From the viewpoint of thinning and increasing the rigidity of the membrane switch 1, the thickness of the lower layer 40 is set in the range of 5 to 50 μm, or in the range of 10 to 30 μm. According to one or more embodiments, the thickness of the lower insulating layer 40 is set to 15 μm, and is set to be smaller than the thickness of the lower substrate 21. The rigidity of the lower insulating layer 40 is set higher than the rigidity of the adhesive layer 50. According to one or more embodiments, from the viewpoint of improving the accuracy of the film thickness of the lower insulating layer 40, a UV curable resin is used as the resist material, and the lower insulating layer 40 is formed by curing the UV curable resin printed on the upper surface 211 of the lower substrate 21 by a UV curing process. The "thickness of the lower insulating layer 40" according to one or more embodiments is a thickness of a flat portion of the lower insulating layer 40 except for a portion raised by the lower base portion 26 (described later).

A circular opening portion 41 having a larger diameter than that of the upper and lower electrodes 12 and 22 is formed in the lower insulating layer 40. The opening portion 41 is provided so as to surround the lower electrode 22, and specifically, the center of the lower electrode 22 substantially coincides with the center of the opening portion 41. The diameter of the opening portion 41 is not particularly limited, but may be 5 mm or less from the viewpoint of stabilizing the ON load of the membrane switch 1. However, it may be 1 mm or more so that the ON load is not excessively increased.

The shape of the opening portion 41 is not limited to a circular shape, and may be, for example, a rectangular shape or the like. The "lower insulating layer 40" according to one or more embodiments corresponds to an example of the "second spacer" in the present invention, and the "opening portion 41" according to one or more embodiments corresponds to an example of the "third opening portion" in the present invention.

Further, the lower electrode sheet 20 according to one or more embodiments includes a lower base portion (a foundation) 26 interposed between the lower substrate 21 and the lower insulating layer 40. As shown in FIG. 3, the lower base portion 26 surrounds the lower electrode 22 and has an annular shape having a slit portion 261 at a position corresponding to the lower lead wiring 23. The slit portion 261 extends along the radial direction of the annular shape and divides the annular shape extending along the circumferential direction. By passing through the slit portion 261, the lower lead wiring 23 is led out to the outside of the opening portion 41 of the lower insulating layer 40 in a see-through plan view. The lower base portion 26 is disposed so as to include a region overlapping an edge portion 53 (described later) of the opening portion 51 of the adhesive layer 50 in a see-through plan view, and the edge portion 42 of the opening portion 41 of the lower insulating layer 40 is raised (swelled) toward the upper electrode sheet 10 by the lower base portion 26 in comparison with other portions of the lower insulating layer 40.

The annular (ring) shape of the lower base portion 26 is not particularly limited to a true circle, and may be, for example, an ellipse, a triangle, a rectangle, a polygon, or the like. Further, if the lower base portion 26 is disposed so as to overlap at least a part of the edge portion 53 of the opening portion 51 of the adhesive layer 50 (overlap at least a part of the peripheral edge of the opening portion 51 of the adhesive layer 50) while avoiding interference with the lower lead wiring 23, the shape of the lower base portion 26 is not limited to an annular shape having the slit portion 261, and may be, for example, an intermittent annular shape (for example, a shape composed of a plurality of island portions arranged in an annular manner).

The lower base portion 26 is formed by printing and curing a conductive paste such as a silver paste, a copper paste, or a carbon paste on the upper surface 211 of the lower substrate 21, and is directly formed on the upper surface 211 of the lower substrate 21 without interposing an adhesive or the like. As a printing method for forming the lower base portion 26, a screen printing method, a gravure offset printing method, an inkjet printing method, or the like can be exemplified. As described above, since the lower insulating layer 40 covering the lower base portion 26 is formed on the upper surface 211 of the lower substrate 21 by the printing method, no void is formed between the lower base portion 26 and the lower insulating layer 40 (i.e., the periphery of the lower base portion 26 in the lower insulating layer 40), and the lower insulating layer 40 is in contact with the entire side surface (end surface) of the lower base portion 26.

The material of which the lower base portion 26 is made is not limited to the above-mentioned conductive material, and may be, for example, an electrically insulating material such as a resin material. However, the lower electrode 22 and the lower lead wiring 23 may be formed in the same process, and in this case, the material composition of the lower base portion 26 is the same as the material composition of the lower lead wiring 23. Further, the rigidity of the lower base portion 26 may be set higher than the rigidity of the lower insulating layer 40.

The thickness of the lower base portion 26 is not particularly limited, but may be substantially the same as the thickness of the lower lead wiring 23. As a result, it is possible to restrain the occurrence of recesses (depressions) or protrusions on the surfaces of the substrates 11 and 21 at the portions corresponding to the slit portion 261 of the lower base portion 26. According to one or more embodiments, the lower base portion 26 has a thickness of about 2 to 20 μm.

The thickness of the upper base portion 16 and the thickness of the lower base portion 26 may satisfy the above equation (3). As a result, it is possible to restrain the occurrence of recesses (depressions) or protrusions on the surfaces of the substrates 11 and 21 at the positions corresponding to the base portions 16 and 26. Although not particularly illustrated, the vertex of the upper base portion 16 and the vertex of the lower base portion 26 may be in contact with each other.

The adhesive layer 50 is interposed between the upper insulating layer 30 and the lower insulating layer 40, and has a function of adhering them. The adhesive layer 50 may include a resin material, and may further include an additive or the like. As a resin material of which the adhesive layer 50 is made, it can be appropriately selected and used in accordance with the pressure sensitivity of the membrane switch 1, for example, a thermoplastic resin, a thermosetting resin, or the like can be exemplified.

From the viewpoint of thinning the membrane switch 1, the thickness of the adhesive layer 50 is set in the range of 5 to 50 μm, or in the range of 10 to 30 μm. In addition, the thickness of the adhesive layer 50 may satisfy the above formula (3). As a result, it is possible to restrain the occurrence of recesses (depressions) or protrusions on the surfaces of the substrates 11 and 21 at the positions corresponding to the base portions 16 and 26. According to one or more embodiments, the thickness of the adhesive layer 50 is set to 15 μm, and is set to be smaller than the thickness of the upper substrate 11 and smaller than the thickness of the lower substrate 21.

Examples of the thermoplastic resin include vinyl acetate resin, polyvinyl alcohol, polyvinyl acetal, ethylene/vinyl acetate resin (EVA), vinyl chloride resin, acrylic resin, polyamide resin, α-olefin resin, and the like. Examples of the thermosetting resin include urea resin, melamine resin, phenol resin, resorcinol resin, epoxy resin, and urethane resin.

The adhesive layer 50 according to one or more embodiments has an opening portion 51 and an air vent 52. The adhesive layer 50 is uniformly formed on the substantially entire surface between the upper insulating layer 30 and the lower insulating layer 40 except for the opening portion 51 and the air vent 52.

The opening portion 51 has a circular outer shape corresponding to the upper and lower electrodes 12 and 22. The opening portion 51 is a through hole that penetrates the adhesive layer 50 in the vertical direction (Z direction) and opens on both main surfaces of the adhesive layer 50.

The opening portion 51 is provided at a position corresponding to the upper and lower electrodes 12 and 22, and specifically, the center of the opening portion 51 substantially coincides with the center of the upper and lower electrodes 12 and 22. As a result, according to one or more embodiments, the centers of the opening portions 31, 41, and 51 substantially coincide with each other.

The air vent 52 is formed between the upper insulating layer 30 and the lower insulating layer 40. The air vent 52 is a through hole for communicating the internal space S around the upper and lower electrodes 12 and 22 (i.e., the opening portions 31 to 51) with the external space.

According to one or more embodiments, the air vent 52 allows air in the internal space S to be sucked and exhausted in accordance with the pressing operation of the operator. That is, when the pressing force is applied by the operator, the air in the internal space S is discharged from the air vent 52, and when the pressing force is released by the operator, the air is taken into the internal space S from the air vent 52. In this manner, by not sealing the internal space S, it is possible to prevent the operator from feeling uncomfortable.

Such an adhesive layer 50 can be formed by, for example, coating and drying an adhesive material constituting the adhesive layer 50 on the lower insulating layer 40 by using a known method such as a gravure coating method, a roll coating method, a screen printing method, a gravure offset printing method, or an ink-jet printing method. According to one or more embodiments, the adhesive layer 50 is formed by using a printing technique such as a screen printing method.

According to one or more embodiments, the adhesive layer 50 is formed on the lower insulating layer 40, and then the upper insulating layer 30 is placed on the adhesive layer 50, and the upper insulating layer 30 and the lower insulating layer 40 sandwiching the adhesive layer 50 are bonded to each other by lamination processing. However, this is not essential, and the adhesive layer 50 may be formed on the upper insulating layer 30, and then the lower insulating layer 40 may be placed on the adhesive layer 50, and the upper insulating layer 30 and the lower insulating layer 40 sandwiching the adhesive layer 50 may be bonded to each other by lamination processing.

The opening portion 51 and the air vent 52 may be formed in the adhesive layer 50 by applying an adhesive material to the entire surface of one of the upper and lower insulating layers 30 and 40, and then laminating a mask on the adhesive material and patterning the adhesive material. Alternatively, the opening portion 51 and the air vent 52 may be formed in the adhesive layer 50 by applying the adhesive material to the entire surface of one of the upper and lower insulating layers 30 and 40 and then partially scraping off the adhesive material. Alternatively, the third opening portion 51 and the air vent 52 may be formed in the adhesive layer 50 by selectively applying an adhesive material to one of the upper and lower insulating layers 30 and 40.

According to one or more embodiments, from the viewpoint of restraining unintentional adhesion between the upper electrode sheet 10 and the lower electrode sheet 20 to reduce the switching property, the outer shape of the opening portion 51 of the adhesive layer 50 is larger than the outer shape of the opening portions 31 and 41 of the insulating layers 30 and 40.

Specifically, as shown in FIG. 2, the diameter $D_1$ of the opening portion 51 of the adhesive layer 50 is larger than the diameter $D_2$ of the opening portion 31 of the upper insulating layer 30. In particular, according to one or more embodiments, the diameter $D_1$ of the opening portion 51 of the adhesive layer 50 is 0.4 mm to 1.0 mm larger than the diameter $D_2$ of the opening portion 31 of the upper insulating layer 30.

Similarly, as shown in FIG. 3, the diameter $D_1$ of the opening portion 51 of the adhesive layer 50 is larger than the diameter $D_3$ of the opening portion 41 of the lower insulating layer 40. In particular, according to one or more embodiments, the diameter $D_1$ of the opening portion 51 of the adhesive layer 50 is 0.4 mm to 1.0 mm larger than the diameter $D_3$ of the opening portion 41 of the lower insulating layer 40.

Here, when the difference between the diameter $D_1$ and the diameter $D_2$, $D_3$ is less than 0.4 mm or larger than 1.0 mm, variation occurs in the on-load, and the adhesive layer 50 may not be able to sufficiently exhibit the function required for the adhesive layer. The diameter $D_1$ of the opening portion 51 of the adhesive layer 50 may be larger than the diameter $D_2$, $D_3$ of the opening portions 31 and 41 of the insulating layers 30 and 40.

According to one or more embodiments, the diameter $D_2$ of the opening portion 31 of the upper insulating layer 30 is substantially the same as the diameter $D_3$ of the opening portion 41 of the lower insulating layer 40, but it is not particularly limited thereto. The shape of the opening portion 51 of the adhesive layer 50 is not particularly limited to the above. For example, the opening portion 51 of the adhesive layer 50 may have a rectangular shape or the like.

The thicknesses of the upper insulating layer 30, the adhesive layer 50, and the lower insulating layer 40 are set so that the sum thereof is smaller than the thickness of the upper substrate 11 or the lower substrate 21. The "adhesive layer 50" according to one or more embodiments corresponds to an example of the "adhesive" in the present invention, and the "opening portion 51" according to one or more embodiments corresponds to an example of the "first opening portion" in the present invention.

As shown in FIG. 1, the rubber dome 60 is attached to the upper surface of the upper substrate 11 of the upper electrode sheet 10. The rubber dome 60 is an elastic member made of a rubber material or the like, which is provided for returning the key top to its original position when a pressing force is transmitted through a key top provided above the rubber dome 60 in a vertically movable state.

The rubber dome 60 includes a dome-shaped main body portion 61 protruding toward the side away from the upper substrate 11 of the upper electrode sheet 10, and an attachment portion 62 extending outward from the edge portion of the main body portion 61.

According to one or more embodiments, the rubber dome 60 is directly attached to the upper surface of the upper substrate 11 of the upper electrode sheet 10, but it is not particularly limited thereto. For example, although not particularly illustrated, a support member made of PET or the like may be provided on the upper surface of the upper base 11 of the upper electrode sheet 10, and the rubber dome 60 may be attached to the upper substrate 11 of the upper electrode sheet 10 via the support member. The rubber dome 60 has a function as a pressing member for assisting the pressing operation of the membrane switch 1. The pressing member is not limited to a rubber dome, and may be a metal dome, or may be a projection provided on the lower surface of the key top. It is not essential to provide the pressing member.

The attachment portion 62 is an annular member formed over the entire circumference of the main body portion 61, and is in close contact with the upper surface of the upper substrate 11 of the upper electrode sheet 10. The outer shape of the main body portion 61 and the outer shape of the attachment portion 62 are circular in plan view. The rubber dome 60 is formed so that the center of the main body portion 61 substantially coincides with the center of the attachment portion 62.

Figure 4:
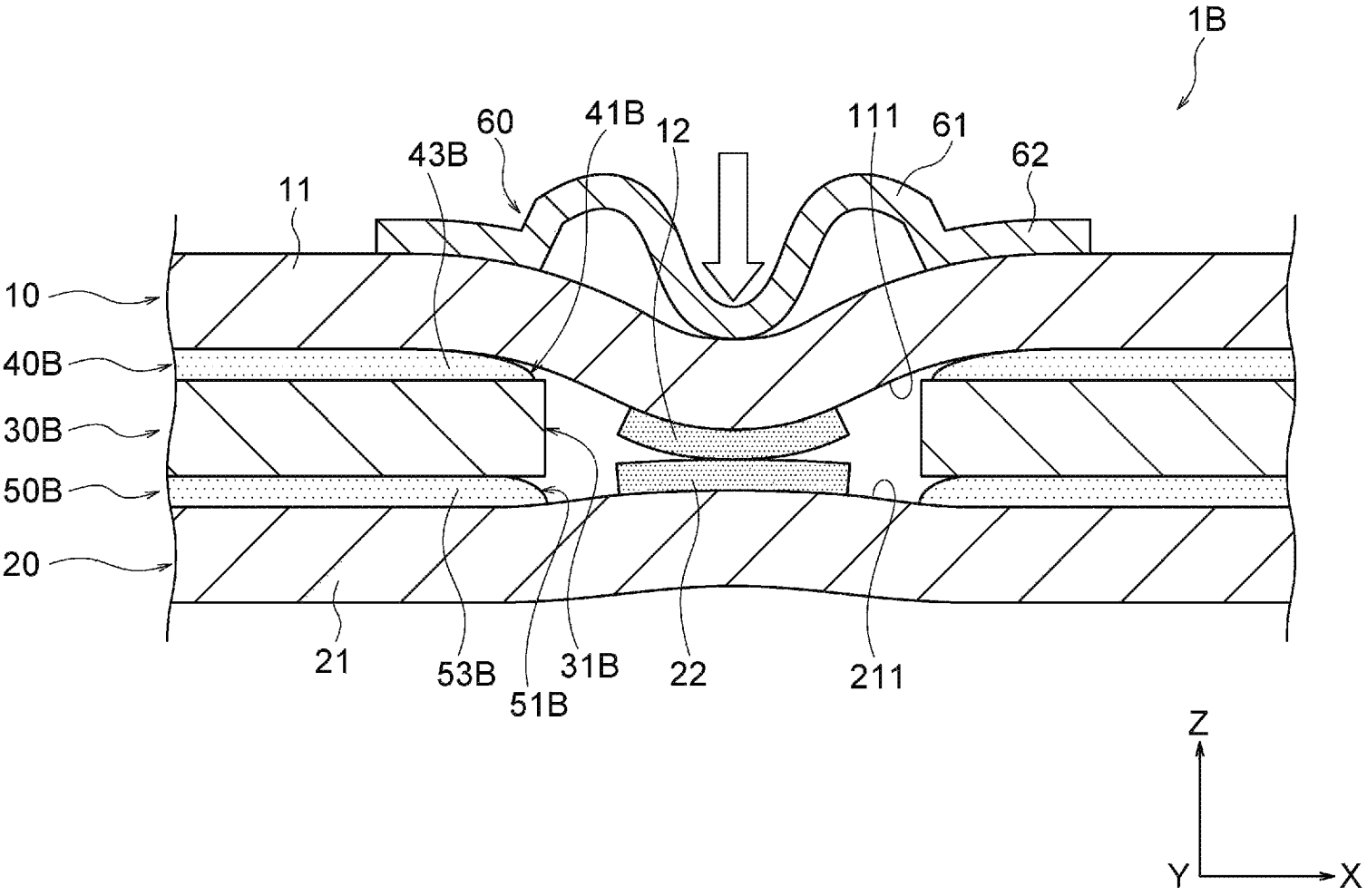
FIG. 4 is a cross-sectional view showing a state at the time of a pressing operation of the membrane switch in the comparative example.

FIG. 4 is a cross-sectional view showing a state at the time of a pressing operation of the membrane switch in the comparative example. In the description of the comparative example, the same components as those according to the above-described embodiments are denoted by the same reference numerals, and the description according to the above-described embodiments is used.

As shown in FIG. 4, the membrane switch 1B according to one or more embodiments includes an upper electrode sheet 10, a lower electrode sheet 20, a spacer 30B, an upper adhesive layer 40B, a lower adhesive layer 50B, and a rubber dome 60. In this membrane switch 1B, the spacer 30B is provided between the upper electrode sheet 10 and the lower electrode sheet 20, the upper surface of the spacer 30B and the lower surface of the upper electrode sheet 10 are adhered by the upper adhesive layer 40B, and the lower surface of the spacer 30B and the upper surface of the lower electrode sheet 20 are adhered by the lower adhesive layer 50B. In this comparative example, the upper electrode sheet 10 does not include the upper insulating layer 30, and the lower electrode sheet 20 does not include the lower insulating layer 40.

The spacer 30B is a PET film. An opening portion 31B is formed in the spacer 30B so as to correspond to the upper and lower electrodes 12 and 22. On the other hand, an opening portion 41B is formed in the upper adhesive layer 40B so as to correspond to the upper and lower electrodes 12, 22, and an opening portion 51B is formed in the lower adhesive layer 50B so as to correspond to the upper and lower electrodes 12, 22. The peripheral edge of the opening portion 41B is positioned outside the peripheral edge of the opening portion 31B. The peripheral edge of the opening portion 51B is also positioned outside the peripheral edge of the opening portion 31B.

Here, since the adhesive material has fluidity when the upper adhesive layer 40B is formed, the edge portion 43B of the upper adhesive layer 40B sags. As a result, a gap is formed between the edge portion 43B and the upper substrate 11 of the upper electrode sheet 10. Therefore, when the pressing force is applied to the upper substrate 11 via the rubber dome 60 and the upper substrate 11 is recessed, the upper substrate 11 contacts the edge portion 43B of the upper adhesive layer 40B, and the adhesive force of the edge portion 43B of the upper adhesive layer 40B acts on the upper substrate 11 and resists the restoring force of the upper substrate 11 from the elastically deformed state.

Similarly, since the adhesive material has fluidity when the lower adhesive layer 50B is formed, the edge portion 53B of the lower adhesive layer 50B also sags. As a result, a gap is formed between the edge portion 53B and the lower substrate 21 of the lower electrode sheet 20. When the lower electrode sheet 20 of the membrane switch 1 is not firmly fixed to the housing of the keyboard device or the like, not only the upper electrode sheet 10 but also the edge portion 53B of the lower adhesive layer 50B comes into contact with the spacer 30B along with applying the pressing force to the upper substrate 11, and the adhesive force of the edge 53B of the lower adhesive layer 50B resists the restoring force from the elastically deformed state of the lower substrate 21.

In this comparative example, in order to reduce the thickness of the membrane switch 1B, the substrates 11 and 21 of the electrode sheets 10 and 20 are set to be thin, and the rigidity of the substrates 11 and 21 is low. Therefore, when the pressing force is applied to the upper substrate 11, the portion of the upper substrate 11 facing the edge portion 43B of the upper adhesive layer 40B is easily bent. Further, when the lower substrate 21 is not firmly fixed to a housing such as a keyboard device, a portion of the lower substrate 21 corresponding to the edge portion 53B of the lower adhesive layer 50B is also easily bent. Therefore, the adhesive force of the edge portions 43B and 53B of the adhesive layers 40B and 50B exceeds the restoring force from the elastically deformed state of the substrates 11 and 21, and the state in which the substrates 11 and 21 are adhered in a state following the shape of the edge portions 43B and 53B of the adhesive layers 40B and 50B (i.e., the state in which the contact portions of the upper electrode sheet 10 are recessed) is maintained.

On the other hand, in the membrane switch 1 according to one or more embodiments, since the upper insulating layer 30 is formed around the upper electrode 12 on the lower surface 111 of the upper substrate 11, and the upper substrate 11 and the upper insulating layer 30 are integrated around the upper electrode 12, the upper substrate 11 is reinforced by the upper insulating layer 30. As a result, when the pressing force is applied to the upper substrate 11 via the rubber dome 60, the portion of the upper substrate 11 where the upper electrode 12 is provided is recessed, whereas the portion where the upper substrate 11 and the upper insulating layer 30 are integrated is hard to bend.

Similarly, since the lower insulating layer 40 is formed around the lower electrode 22 on the upper surface 211 of the lower substrate 21, and the lower substrate 21 and the lower insulating layer 40 are integrally formed around the lower electrode 22, the lower substrate 21 is reinforced with the lower insulating layer 40. As a result, even if the lower substrate 21 is not firmly fixed to the housing of the keyboard device or the like, when the pressing force is applied to the upper substrate 11 via the rubber dome 60, the portion of the lower substrate 21 where the lower electrode 22 is provided is recessed, whereas the portion where the lower substrate 21 and the lower insulating layer 40 are integrated is hard to bent.

Therefore, even if the edge portion 53 of the adhesive layer 50 sags, the restoring force from the elastically deformed state of the substrates 11 and 21 and the insulating layers 30 and 40 exceeds the adhering force of the edge portion 53 of the adhesive layer 50. Therefore, it is possible to prevent the state in which the substrates 11 and 21 are adhered in a state following the shape of the edge portion 53 of the adhesive layer 50 (i.e., the state in which the contact portions of the electrode sheets 10 and 20 are recessed) from being maintained, and to prevent the ON state from being maintained.

In the first place, according to one or more embodiments, the upper base portion 16 is disposed so as to include a region overlapping the edge portion 53 of the opening portion 51 of the adhesive layer 50 in a see-through plan view, and the upper insulating layer 30 is raised (swelled) toward the lower electrode sheet 20 at a portion corresponding to the upper base portion 16 by the upper base portion 16 in comparison with other portions of the upper insulating layer 30. Similarly, the lower base portion 26 is disposed so as to include a region overlapping the edge portion 53 of the opening portion 51 of the adhesive layer 50 in a see-through plan view, and the lower insulating layer 40 is raised (swelled) toward the upper electrode sheet 10 at a portion corresponding to the lower base portion 26 by the lower base portion 26 in comparison with other portions of the lower insulating layer 40.

According to one or more embodiments, since it is possible to cancel the sag of the adhesive by the swelling of the adhesive layer 50 by the base portions 16 and 26, it is possible to restrain the state in which the substrates 11 and 21 are adhered in a state following the shape of the edge portion 53 of the adhesive layer 50 (i.e., the state in which the contact portions of the upper electrode sheets 10 and 20 are recessed) from being maintained after the pressing operation of the membrane switch 1.

The membrane switch 1 according to one or more embodiments can be made thinner than the membrane switch 1B in the comparative examples.

That is, according to one or more embodiments, the upper insulating layer 30 is formed by printing on the upper electrode sheet 10 and curing, and the lower insulating layer 40 is formed by printing on the lower electrode sheet 20 and curing. Here, by forming the upper insulating layer 30 and the lower insulating layer 40 by the printing method, the upper insulating layer 30 and the lower insulating layer 40 can be made thinner than the spacer 30B made of the PET film in the comparative example. According to one or more embodiments, one adhesive layer 50 is formed, whereas in the comparative example, upper and lower adhesive layers 40B and 50B are formed. Thus, according to one or more embodiments, the thickness of the adhesive can be reduced in comparison with the comparative example, and the membrane switch 1 according to one or more embodiments can be made thinner than the membrane switch 1B in the comparative example.

In particular, according to one or more embodiments, the sum of the thickness of the upper insulating layer 30, the thickness of the adhesive layer 50, and the thickness of the lower insulating layer 40 is set to be smaller than the thickness of the upper substrate 11 or the lower substrate 21. Therefore, it is possible to reduce the thickness of the membrane switch 1, and to restrain the recesses occurring in the contact portions of the upper electrode sheet 10 and the lower electrode sheet 20.

Figure 5:
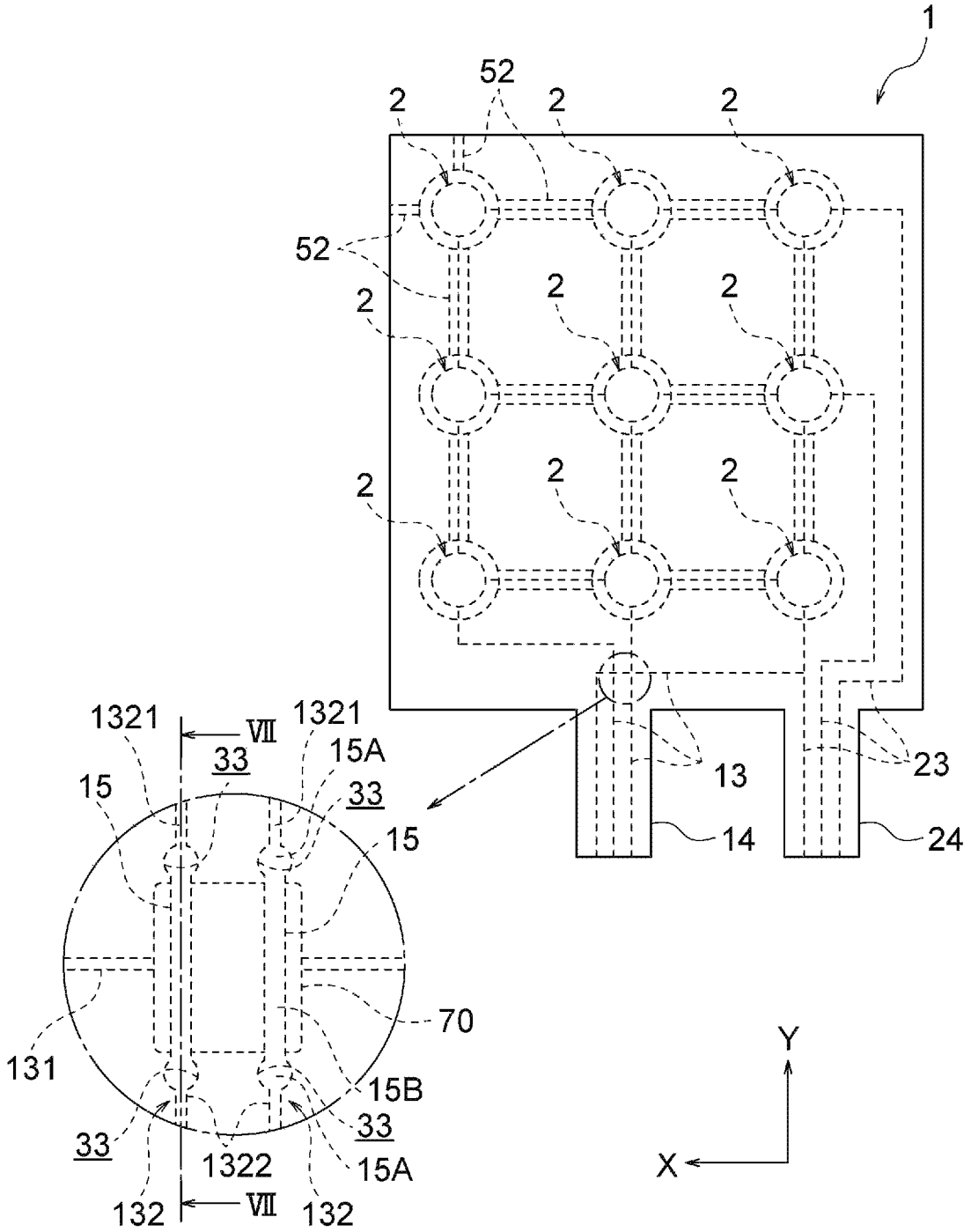
FIG. 5 is a plan view showing a membrane switch according to one or more embodiments of the present invention.
Figure 6:
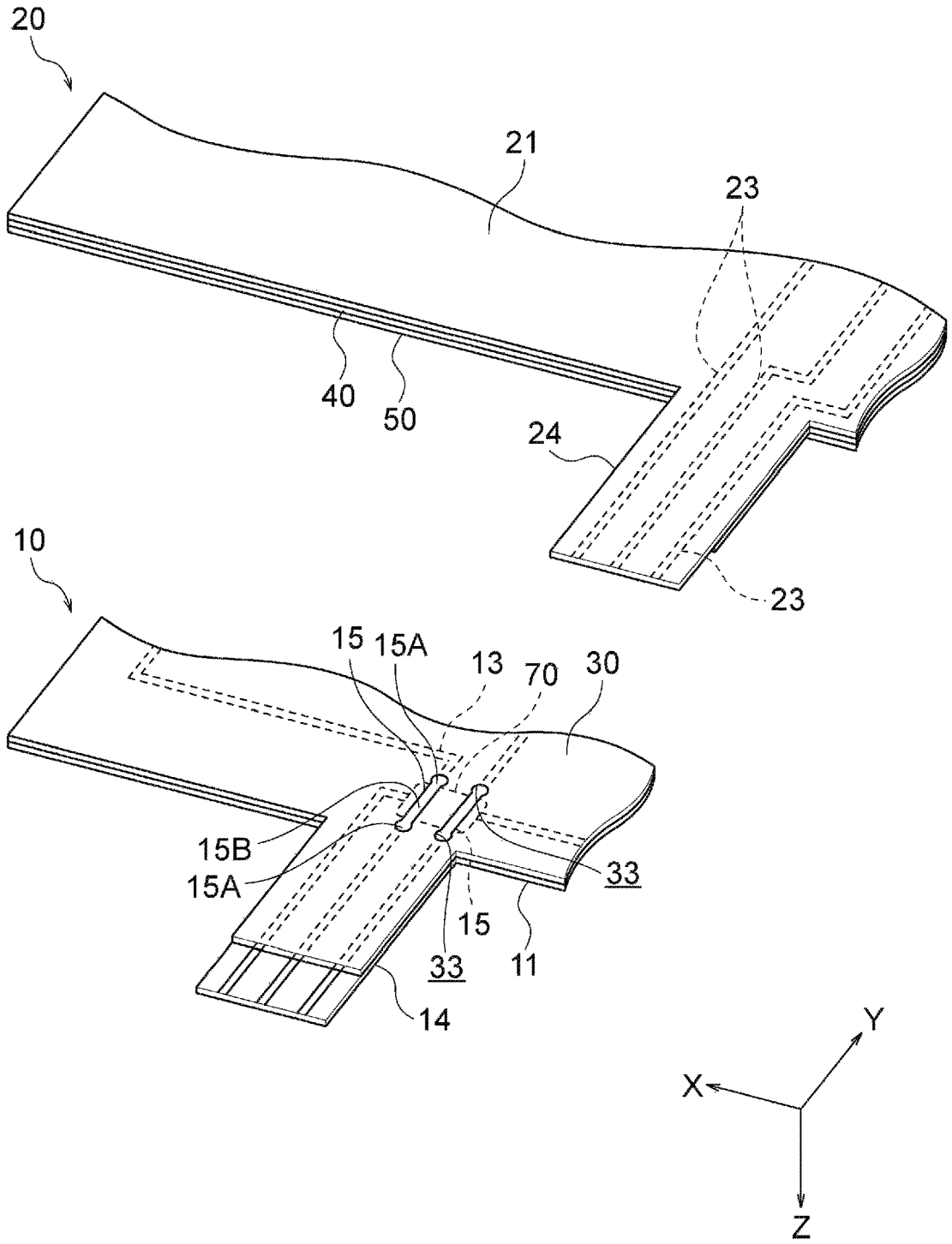
FIG. 6 is an exploded perspective view showing a membrane switch according to one or more embodiments of the present invention.

FIG. 5 is a plan view showing the membrane switch 1 according to one or more embodiments of the present invention, and FIG. 6 is an exploded perspective view showing the membrane switch 1 according to one or more embodiments of the present invention. FIGS. 5 and 6 show a case where the membrane switch 100 is viewed from the lower electrode sheet 20 side.

As shown in FIGS. 5 and 6, the membrane switch 1 includes a plurality of electrode pairs 2 each of which is composed of an upper electrode 12 and a lower electrode 22. The membrane switch 1 includes an upper tail portion 14 which is provided on one side of the upper substrate 11 and on which a plurality of upper lead wirings 13 are formed, and a lower tail portion 24 which are provided on one side of the lower substrate 21 and on which a plurality of lower lead wirings 23 are formed.

The upper lead wiring 13 connects a plurality of upper electrodes 12 arranged in a line and extends to the tip of the upper tail portion 14. Here, the plurality of upper lead wirings 13 are wired so that the two upper lead wirings 13 and the remaining one upper lead wiring 13 intersect with each other. Therefore, jumper portions 15 are provided at two intersections where the two upper lead wirings 13 and the remaining one upper lead wiring 13 intersect with each other. The detailed configuration of the jumper portion 15 will be described later.

On the other hand, the lower lead wiring 23 connects a plurality of lower electrodes 22 arranged in a line and is wired so as to extend to the tip of the lower tail portion 24. The plurality of lower lead wirings 23 are wired so as not to intersect with each other. Therefore, the lower lead wiring 23 is not provided with a jumper portion.

The upper insulating layer 30 is formed directly and integrally with the upper substrate 11 so as to cover the upper lead wiring 13. According to one or more embodiments, the upper lead wiring 13 formed on the upper substrate 11 is covered with the upper insulating layer 30 except for the position facing the opening portion 31.

The upper lead wiring 13 on the upper tail portion 14 may be covered with the upper insulating layer 30 or may be covered with another insulating layer formed on the upper tail portion 14 instead of the upper insulating layer 30. It is not essential that the upper lead wiring 13 on the upper substrate 11 is covered with the upper insulating layer 30 over the entire area of the upper substrate 11, and a part of the upper lead wiring 13 on the upper substrate 11 may be covered with another insulating material.

The lower insulating layer 40 is also formed directly and integrally with the lower substrate 21 so as to cover the lower lead wiring 23. According to one or more embodiments, the lower lead wiring 23 on the lower substrate 21 is covered with the lower insulating layer 40 except for the position facing the second opening portion 41.

The lower lead wiring 23 on the lower tail portion 24 may be covered with the lower insulating layer 40 or may be covered with another insulating material formed on the lower tail portion 24 instead of the lower insulating layer 40. Further, it is not essential that the lower lead wiring 23 on the lower substrate 21 is covered with the lower insulating layer 40 over the entire area of the lower substrate 21, and a part of the lower lead wiring 23 on the lower substrate 21 may be covered with another insulating material.

Figure 7:
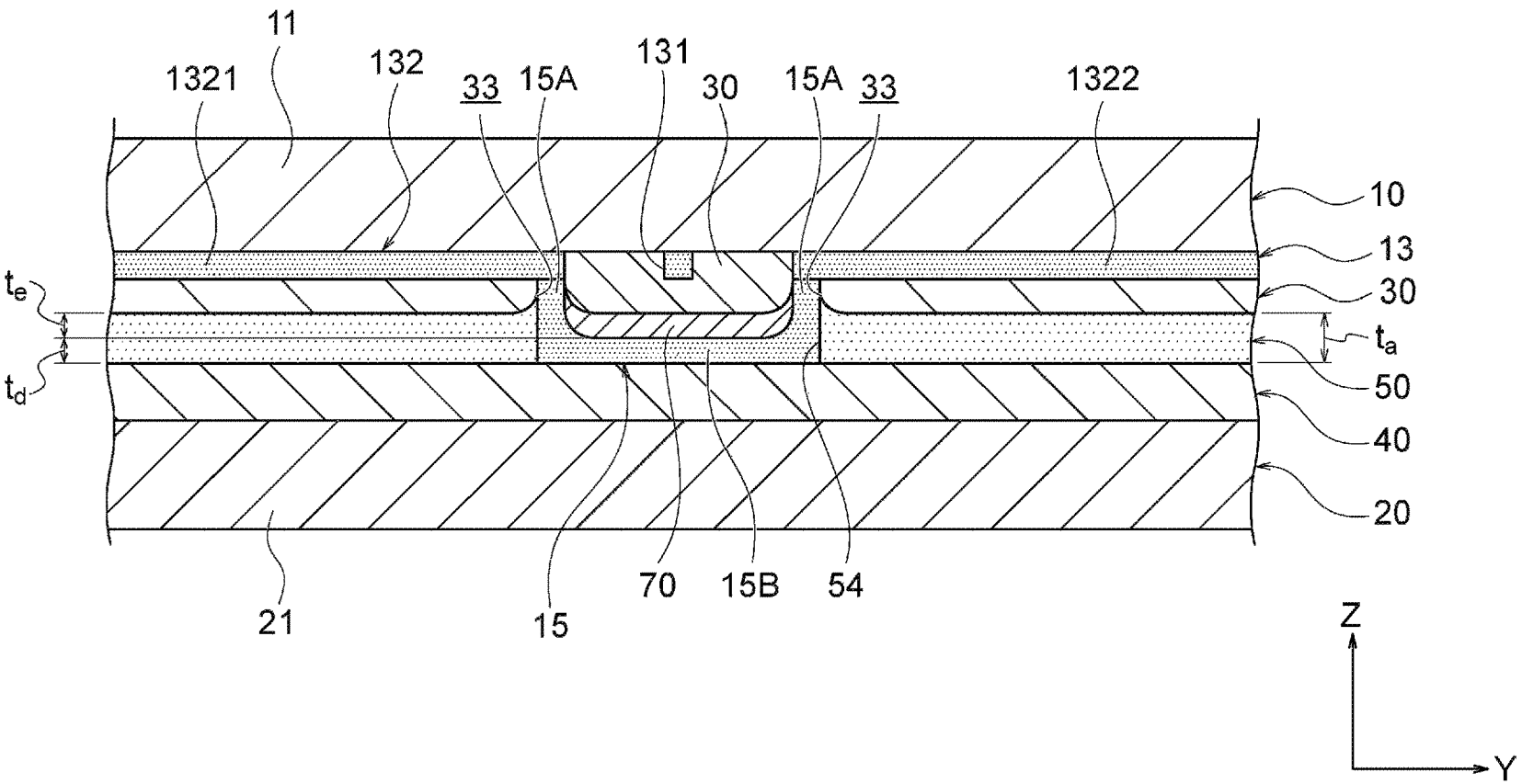
FIG. 7 is a view showing a jumper structure of the membrane switch according to one or more embodiments of the present invention, and is a cross-sectional view taken along the VII-VII line in a partially enlarged view of FIG. 5.

FIG. 7 is a cross-sectional view taken along the VII-VII line of the partially enlarged view of FIG. 5.

As shown in the enlarged view of FIG. 5 and FIG. 7, one upper lead wiring 13 includes a linear portion 131 extending along one side of the upper substrate 11, and the remaining two upper lead wirings 13 include a linear portion 132 intersecting with the linear portion 131. The linear portion 132 is divided into a first main body portion 1321 and a second main body portion 1322 on the upper substrate 11 so as not to intersect with the linear portion 131. An end portion of the first main body portion 1321 and an end portion of the second main body portion 1322 are connected by the jumper portion 15.

The upper insulating layer 30 includes a pair of jumper opening portions 33, 33. One jumper opening portion 33 is formed at a position facing the end portion of the first main body portion 1321. The end portion of the first main body portion 1321 and the jumper opening portion 33 overlap each other in a see-through plan view so that the end portion of the first main body portion 1321 is exposed from the upper insulating layer 30.

Similarly, the other jumper opening portion 33 is formed at a position facing the end portion of the second main body portion 1322. The end portion of the second main body portion 1322 and the jumper opening portion 33 overlap each other in a see-through plan view so that the end portion of the second main body portion 1322 is exposed from the upper insulating layer 30.

The jumper portion 15 is formed so as to span the linear portion 131 on the upper substrate 11 and includes a pair of jumper connecting portions 15A and a jumper wiring portion 15B for connecting the pair of jumper connecting portions 15A. Each jumper connection portion 15A is filled in the jumper opening portion 33 and is connected to the end of the first main body portion 1321 or to the end of the second main body portion 1322.

The jumper portion 15 is formed by printing and curing a conductive paste such as a silver paste, a copper paste, or a carbon paste. As a printing method for forming the jumper portion 15, a screen printing method, a gravure offset printing method, an inkjet printing method, or the like can be exemplified.

According to one or more embodiments, the jumper insulating layer 70 is formed on the upper insulating layer 30 in a region corresponding to the jumper portion 15. On the other hand, in the periphery of the jumper portion 15, the insulating layer is not interposed between the upper insulating layer 30 and the adhesive layer 50, and the upper insulating layer 30 and the adhesive layer 50 are in direct contact with each other.

The jumper insulating layer 70 is formed by coating and curing a resist material such as epoxy resin, urethane resin, polyester resin, acrylic resin, or the like on the upper insulating layer 30. The jumper wiring portion 15B is formed on the jumper insulating layer 70. Although not particularly illustrated, the jumper wiring portion 15B may be formed on the upper insulating layer 30 without forming the jumper insulating layer 70.

As described above, according to one or more embodiments, the space defined by the jumper portion 15 and the upper surface of the upper substrate 11 is filled with the insulating material constituting the upper insulating layer 30 and the insulating material constituting the jumper insulating layer 70. As a result, it is possible to secure electrical insulation between the linear portion 131 and the jumper portions 15 intersecting with each other.

Further, according to one or more embodiments, an opening portion 54 penetrating the adhesive layer 50 in the vertical direction is formed at a portion of the adhesive layer 50 corresponding to the jumper wiring portion 15B. The jumper wiring portion 15B enters the opening portion 54 and is configured so that the adhesive layer 50 and the jumper wiring portion 15B do not overlap each other. As a result, even at a position where the upper substrate 11 and the jumper insulating layer 70 overlap each other, the upper substrate 11 can be made flat.

In particular, when the jumper portion is disposed in the vicinity of the outer edge of the membrane switch, the adhesive layer cannot follow the height difference due to the jumper portion, a void is formed around the jumper portion, and the void may communicate with the outside of the membrane switch. In such a case, the waterproof performance of the membrane switch may be inferior.

On the other hand, according to one or more embodiments, since the jumper connecting portion 15A enters the opening portion 54 of the adhesive layer 50, the height difference of the adhesive layer 50 due to the jumper portion 15 is reduced. Therefore, since the occurrence of voids around the jumper portion 15 is suppressed, the waterproof performance of the membrane switch 1 can be improved.

Although not particularly limited, the sum of the thickness td of the jumper wiring portion 15B and the thickness te of the jumper insulating layer 70 may be substantially the same as the thickness ta of the adhesive (td+te=ta). As a result, even at a position where the upper substrate 11 and the jumper insulating layer 70 overlap each other, the upper substrate 11 can be made flatter.

Figure 8:
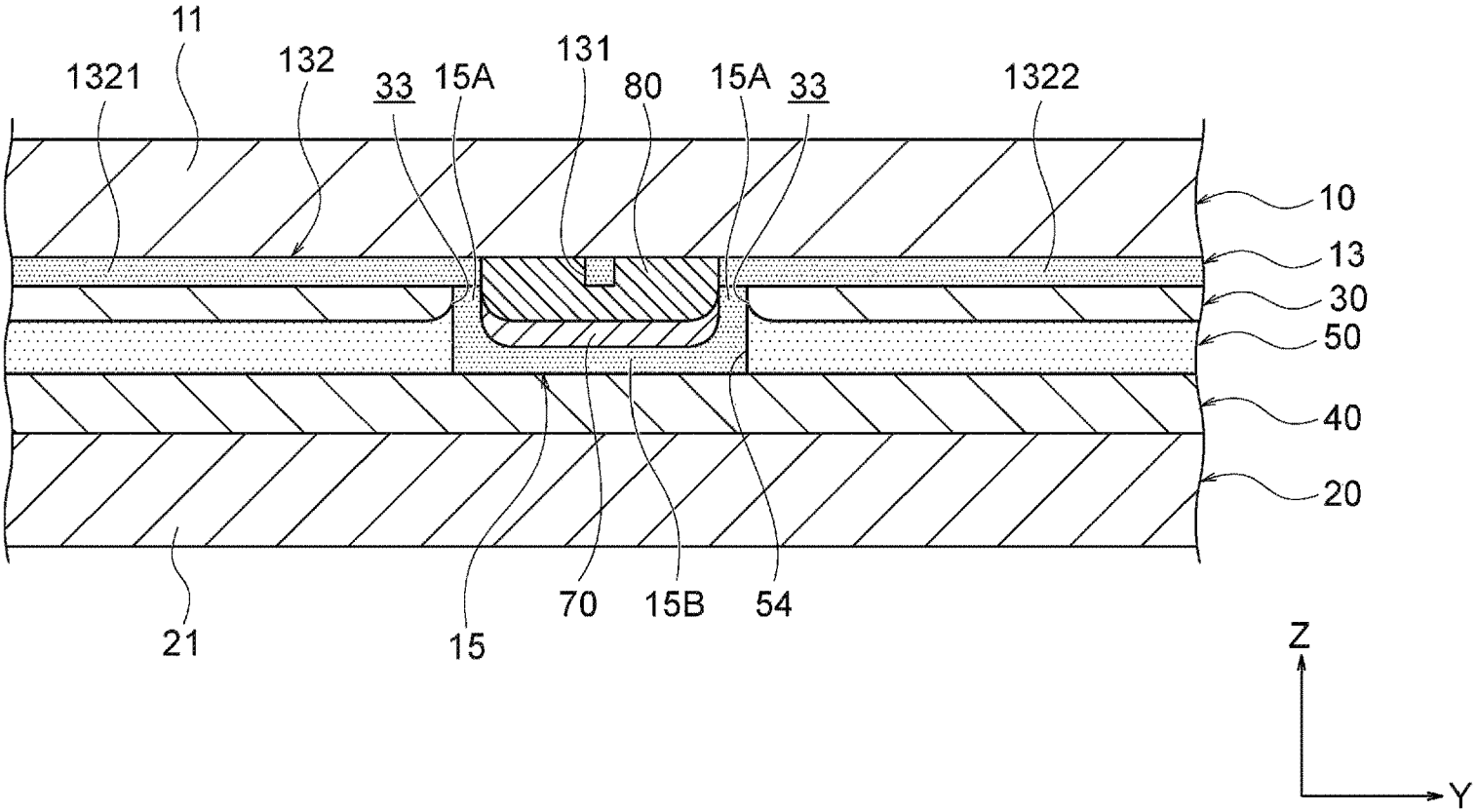
FIG. 8 is a diagram showing a jumper structure of a membrane switch according to one or more embodiments of the present invention.

As shown in FIG. 8, the portion of the upper substrate 11 where the linear portion 131 and the jumper portion 15 intersect with each other may be covered with a covering layer 80 different from the upper insulating layer 30. FIG. 8 is a diagram showing a jumper structure of the membrane switch according to one or more embodiments of the present invention. The covering layer 80 is formed by coating and curing a resist material such as epoxy resin, urethane resin, polyester resin, acrylic resin, or the like on the upper substrate 11. In this case, the jumper opening portion 33 is provided at the boundary between the covering layer 80 and the upper insulating layer 30.

On the other hand, according to one or more embodiments shown in FIG. 7, the material composition of the portion corresponding to the covering portion 80 is the same as the material composition of the upper insulating layer 30. That is, a portion corresponding to the covering portion 80 is formed integrally with the upper insulating layer 30 and constitutes a part of the upper insulating layer 30. A jumper opening portion 33 is formed at a position facing the end portions of the main body portions 1321 and 1322 in the integrally formed upper insulating layer 30.

As described above, according to one or more embodiments, the edge portions 32 and 42 of the opening portions 31 and 41 of the insulating layers 30 and 40 are raised by the base portions 16 and 26 formed on the substrates 11 and 21. Since the sagging of the adhesive can be offset by such rise, it is possible to restrain the state in which the substrates 11 and 21 are adhered in a state following the shape of the edge portion 53 of the adhesive layer 50 (i.e., the state in which the contact portions of the electrode sheets 10 and 20 are recessed) from being maintained after the pressing operation of the membrane switch 1.

Embodiments heretofore explained are described to facilitate understanding of the present invention and are not described to limit the present invention. It is therefore intended that the elements disclosed in the above embodiments include all design changes and equivalents to fall within the technical scope of the present invention.

Figure 9:
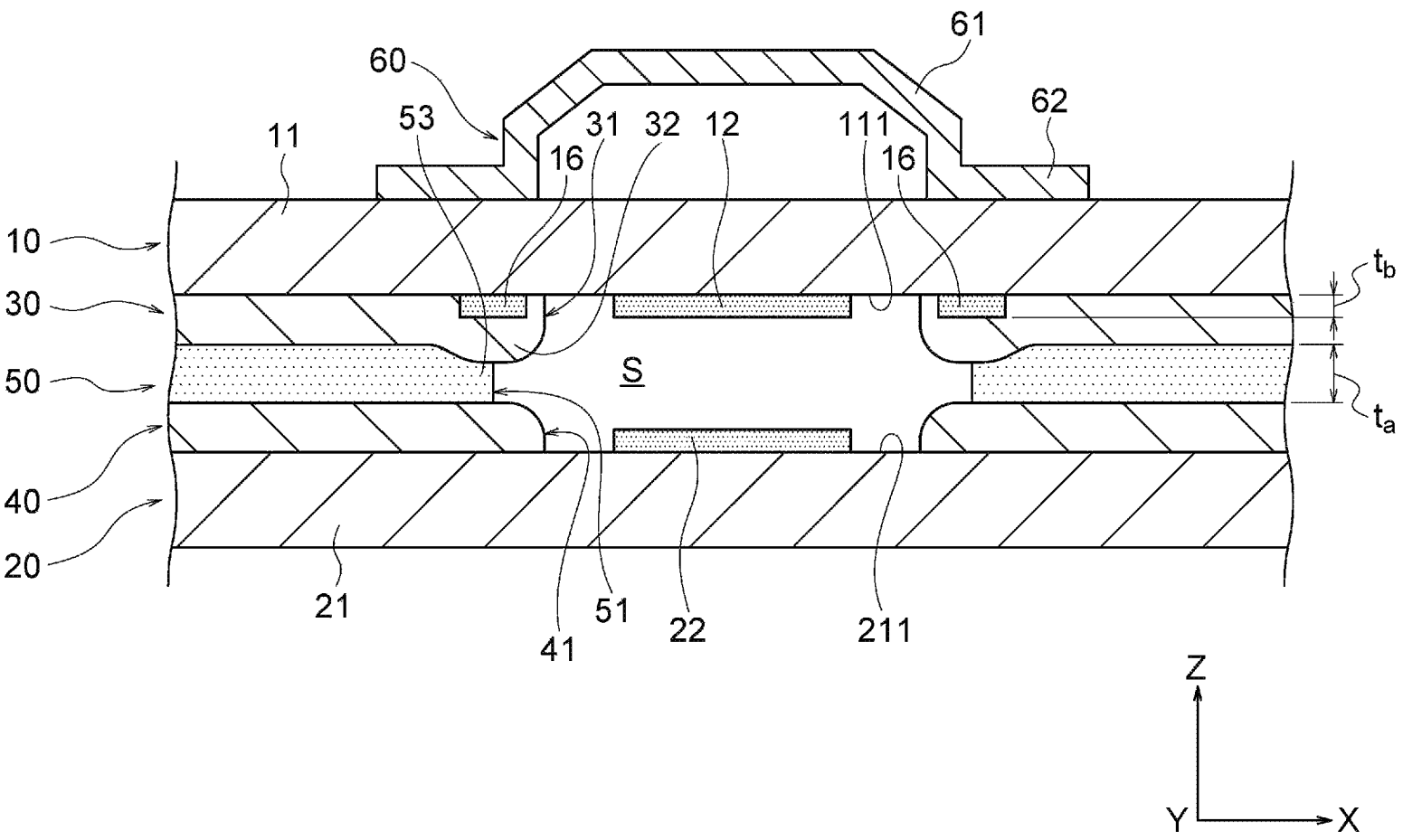
FIG. 9 is a cross-sectional view showing a contact portion of the membrane switch according to one or more embodiments of the present invention.

The base portions 16 and 26 may be provided on at least one of the upper and lower substrates 11 and 21. FIG. 9 is a cross-sectional view showing a contact portion of the membrane switch according to one or more embodiments of the present invention. For example, as shown in FIG. 9, only the upper base portion 16 may be provided on the upper substrate 11, and the lower base portion 26 may not be provided on the lower substrate 21. Alternatively, although not particularly illustrated, the upper base portion 16 may not be provided on the upper substrate 11, and only the lower base portion 26 may be provided on the lower substrate 21.

For example, when only the upper base portion 16 is formed on the upper substrate 11, the thickness of the upper base portion 16 may satisfy the following equation (4). As a result, it is possible to restrain the occurrence of recesses (depressions) or protrusions on the surfaces of the substrates 11 and 21 at the portions corresponding to the upper base portion 16.

$$\frac{1}{2} \times ta \leq tb \leq ta \quad (4)$$

In the above equation (4), ta is the thickness of the adhesive layer 50, and tb is the thickness of the upper base portion 16.

Figure 10:
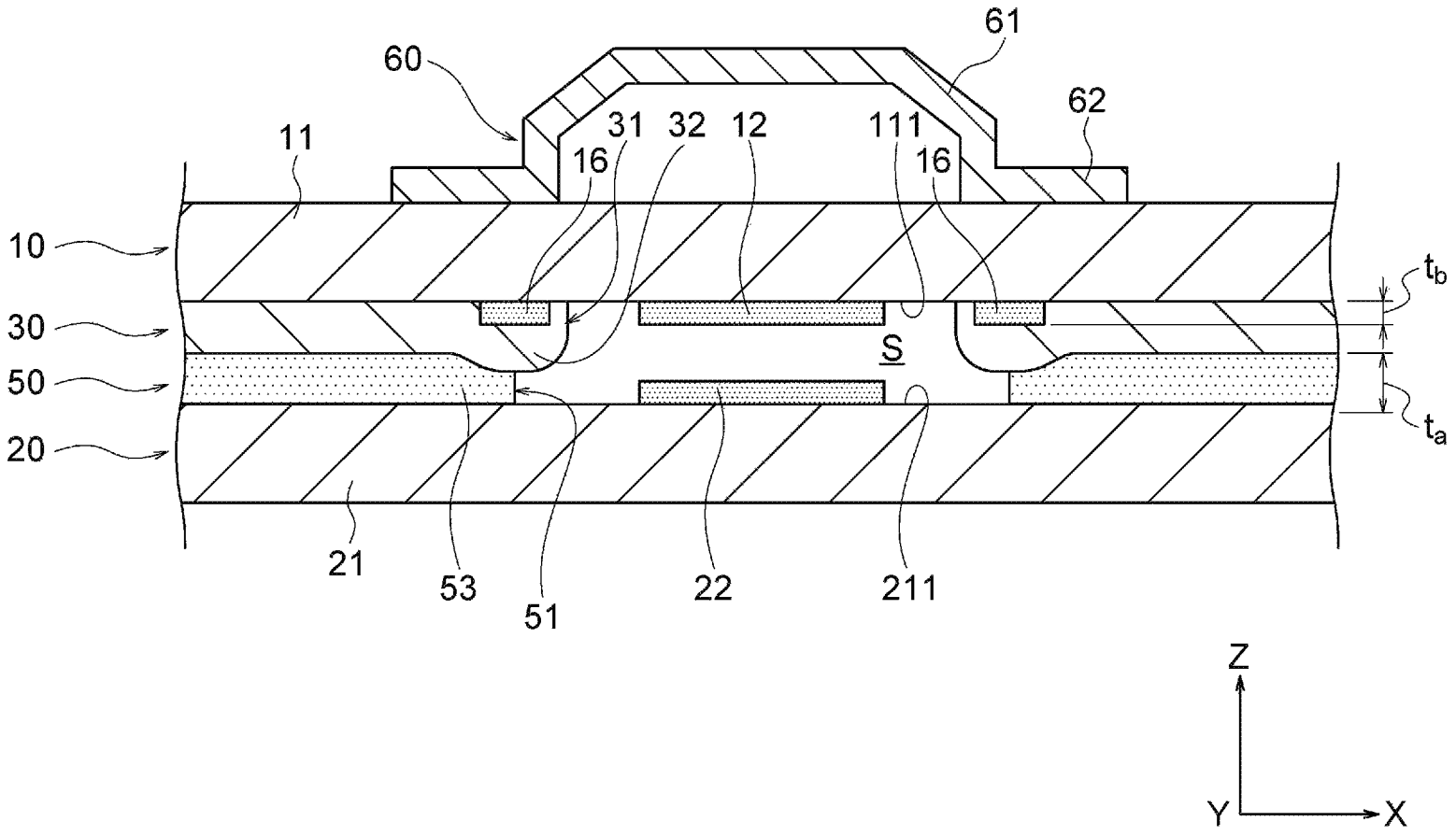
FIG. 10 is a cross-sectional view showing the contact point of the membrane switch according to one or more embodiments of the present invention.

The insulating layers 30 and 40 may be provided on at least one of the upper and lower substrates 11 and 21. FIG. 10 is a cross-sectional view showing a contact portion of the membrane switch according to one or more embodiments of the present invention. For example, as shown in FIG. 10, only the upper insulating layer 30 may be provided on the upper substrate 11, and the lower insulating layer 40 may not be provided on the lower substrate 21. In this case, the lower surface of the upper insulating layer 30 of the upper electrode sheet 10 and the upper surface of the lower substrate 21 of the lower electrode sheet 20 are adhered by the adhesive layer 50. Alternatively, although not particularly illustrated, the upper insulating layer 30 may not be provided on the upper substrate 11, and only the lower insulating layer 40 may be provided on the lower substrate 21.

According to one or more embodiments described above, the example in which the upper electrode sheet 10 includes the jumper portion 15 has been described, but when the lower lead wirings 23 intersect with each other, the lower electrode sheet 20 may include the jumper portion. Alternatively, the upper electrode sheet 10 may include the jumper portion 15, and the lower electrode sheet 20 may include the jumper portion.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 . . . Membrane switch
10 . . . Upper electrode sheet
11 . . . Upper substrate
111 . . . Lower surface
12 . . . Upper electrode
13 . . . Upper lead wiring
131 . . . Linear portion
132 . . . Linear portion
1321 . . . First main body portion
1322 . . . Second main body portion
14 . . . Tail portion
15 . . . Jumper portion
15A . . . Jumper connecting portion
15B . . . Jumper wiring portion
16 . . . Upper base portion
161 . . . Slit portion
20 . . . Lower electrode sheet
21 . . . Lower substrate

211 . . . Upper surface
22 . . . Lower electrode
23 . . . Lower lead wiring
26 . . . Lower base portion
261 . . . Slit portion
30 . . . Upper insulating layer
31 . . . Opening portion
32 . . . Edge portion
33 . . . Jumper opening portion
40 . . . Lower insulating layer
41 . . . Opening portion
42 . . . Edge portion
50 . . . Adhesive layer
51 . . . Opening portion
52 . . . Air vent
53 . . . Edge portion
54 . . . Opening portion
60 . . . Rubber dome
61 . . . Main body portion
62 . . . Attachment portion
70 . . . Jumper insulating layer
80 . . . Covering layer
S . . . Internal space
1B . . . Membrane Switch
30B . . . Spacer
31B . . . Opening portion
40B . . . Upper adhesive layer
41B . . . Opening portion
43B . . . Edge portion
50B . . . Lower adhesive layer
51B . . . Opening portion
152 . . . Edge

The invention claimed is:

1. A switch comprising:
a first electrode sheet comprising a first electrode;
a second electrode sheet comprising a second electrode that faces the first electrode sheet; and
an adhesive that comprises a first opening through which the first electrode faces the second electrode and that attaches the first electrode sheet to the second electrode sheet; wherein
the first electrode sheet comprises:
a first substrate on which the first electrode is disposed;
a first spacer between the first substrate and the second electrode sheet that comprises a second opening at a position corresponding to the first electrode, wherein the first spacer is attached to the second electrode sheet by the adhesive; and
a first base between the first substrate and the first spacer that overlaps at least a portion of an edge of the first opening of the adhesive,
the first spacer is raised, by the first base, toward the second electrode sheet at a portion corresponding to the first base,
the first electrode sheet comprises a lead wiring that is connected to the first electrode and that leads out to an outside of the second opening, and
the first base has an annular shape that surrounds the first electrode and comprises a slit at a portion corresponding to the lead wiring.

2. The switch according to claim 1, wherein a thickness of the first base is substantially identical to a thickness of the lead wiring.

3. The switch according to claim 1, wherein a material composition of the first base is identical to a material composition of the lead wiring.

4. The switch according to claim 1, wherein
the second electrode sheet comprises a second substrate on which the second electrode is disposed, and
the first spacer is attached to the second substrate by the adhesive.

5. The switch according to claim 4, wherein following equation (2) is satisfied:

$$1/2 \times ta \leq tb \leq ta \ldots \quad (2)$$

where ta is a thickness of the adhesive and tb is a thickness of the first base.

6. The switch according to claim 1, wherein the adhesive is disposed outside a periphery of the second opening.

7. The switch according to claim 1, wherein a rigidity of the first spacer is higher than a rigidity of the adhesive.

8. The switch according to claim 1, wherein the first spacer is thinner than the first substrate.

9. A switch comprising:
a first electrode sheet comprising a first electrode;
a second electrode sheet comprising a second electrode that faces the first electrode sheet; and
an adhesive that comprises a first opening through which the first electrode faces the second electrode and that attaches the first electrode sheet to the second electrode sheet; wherein
the first electrode sheet comprises:
a first substrate on which the first electrode is disposed;
a first spacer between the first substrate and the second electrode sheet that comprises a second opening at a position corresponding to the first electrode, wherein the first spacer is attached to the second electrode sheet by the adhesive; and
a first base between the first substrate and the first spacer that overlaps at least a portion of an edge of the first opening of the adhesive,
the first spacer is raised, by the first base, toward the second electrode sheet at a portion corresponding to the first base,
the second electrode sheet comprises:
a second substrate on which the second electrode is disposed;
a second spacer between the second substrate and the first electrode sheet that comprises a third opening at a position corresponding to the second electrode, wherein the second spacer is attached to the first electrode sheet by the adhesive; and
a second base between the second substrate and the second spacer in at least a part of a region that overlaps an edge of the first opening of the adhesive, and
the second spacer is raised, by the second base, toward the first electrode sheet at a portion corresponding to the second base.

10. The switch according to claim 9, wherein following equation (1) is satisfied:

$$1/2 \times ta \leq tb + tc \leq ta \ldots \quad (1)$$

where ta is a thickness of the adhesive, tb is a thickness of the first base, and tc is a thickness of the second base.

* * * * *